US005982710A

United States Patent [19]

Rawat et al.

[11] Patent Number: 5,982,710

[45] Date of Patent: Nov. 9, 1999

[54] METHOD AND APPARATUS FOR PROVIDING TIME USING CARTESIAN COORDINATES

[76] Inventors: Prem P. Rawat, P.O.Box 4134; Rives T. McDow, P.O. Box 6401, both of Malibu, Calif. 90264

[21] Appl. No.: 08/818,762

[22] Filed: Mar. 14, 1997

[51] Int. Cl.[6] ..... G04B 19/22; G04C 17/00

[52] U.S. Cl. ..... 368/21; 368/69

[58] Field of Search ..... 368/10, 15, 17, 368/21, 223, 47, 69.7; 33/268, 269, 354; 364/569

[56] References Cited

U.S. PATENT DOCUMENTS

| | | | |
|---|---|---|---|
| 4,233,593 | 11/1980 | Bigelow . | |
| 4,316,272 | 2/1982 | Naito . | |
| 4,479,722 | 10/1984 | Salah | 368/17 |
| 4,512,667 | 4/1985 | Doulton et al. | 358/10 |
| 4,659,231 | 4/1987 | Barrouki | 368/15 |
| 4,681,460 | 7/1987 | Nishimura . | |
| 4,726,687 | 2/1988 | Gander . | |
| 4,821,248 | 4/1989 | Yamasaki et al. . | |
| 4,884,254 | 11/1989 | Kawai et al. . | |
| 4,887,251 | 12/1989 | Takada et al. . | |
| 5,068,838 | 11/1991 | Klausner et al. . | |
| 5,105,396 | 4/1992 | Ganter et al. . | |
| 5,269,065 | 12/1993 | Ida | 33/269 |
| 5,375,018 | 12/1994 | Klausner et al. . | |
| 5,408,445 | 4/1995 | Allgaier et al. . | |
| 5,477,508 | 12/1995 | Will et al. . | |
| 5,724,316 | 3/1998 | Brunts | 368/10 |

FOREIGN PATENT DOCUMENTS

| | | |
|---|---|---|
| 0 498 199 A2 | 8/1992 | European Pat. Off. . |
| 42 02 435 A1 | 8/1993 | Germany . |
| 44 00 626 | 7/1995 | Germany . |
| 44 00 626 A1 | 7/1995 | Germany . |
| 6180378 | 6/1994 | Japan . |
| 1 368 774 | 10/1976 | Switzerland . |

*Primary Examiner*—Vit Miska
*Attorney, Agent, or Firm*—Christie, Parker & Hale, LLP

[57] ABSTRACT

A world time multi-function watch for providing the local time at any location on earth by entry of the cartesian coordinates of that location through the bezel of the watch or by means of a GPS unit. The bezel is a high resolution input device which enables the cartesian coordinates to be input in increments of one degree. The coordinates are used to access a database of world time zones to determine the time zone in which the entered coordinates lie. Appropriate adjustments are made to reflect time zone adjustments with respect to a predetermined reference time line and to reflect the local observance of daylight savings time. One set of analog hands will automatically move to display the time at the selected location. The watch can be linked to a GPS unit through an optical, spread-spectrum rf or cable interface, by manually entering the information through the bezel, or through a wrist mounted unit linked directly or through an appropriate interface.

30 Claims, 10 Drawing Sheets

FIG. 1B
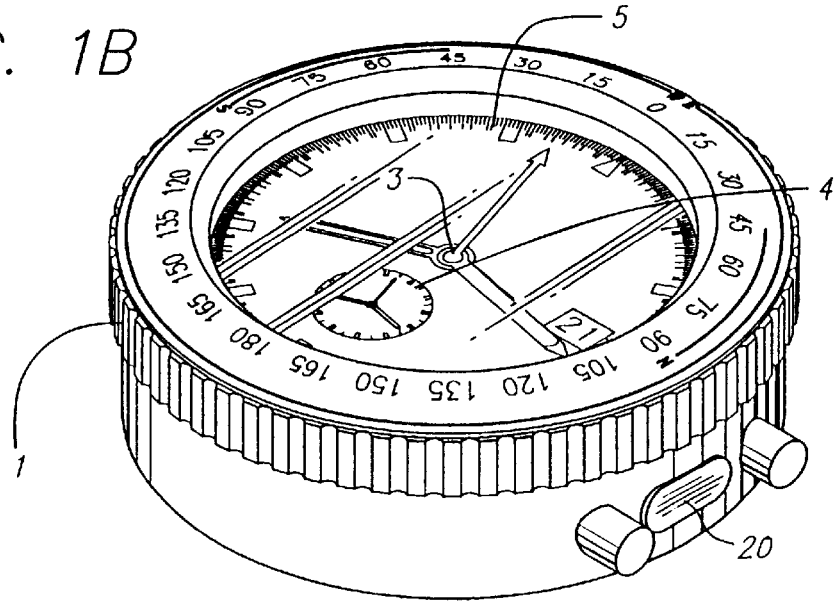
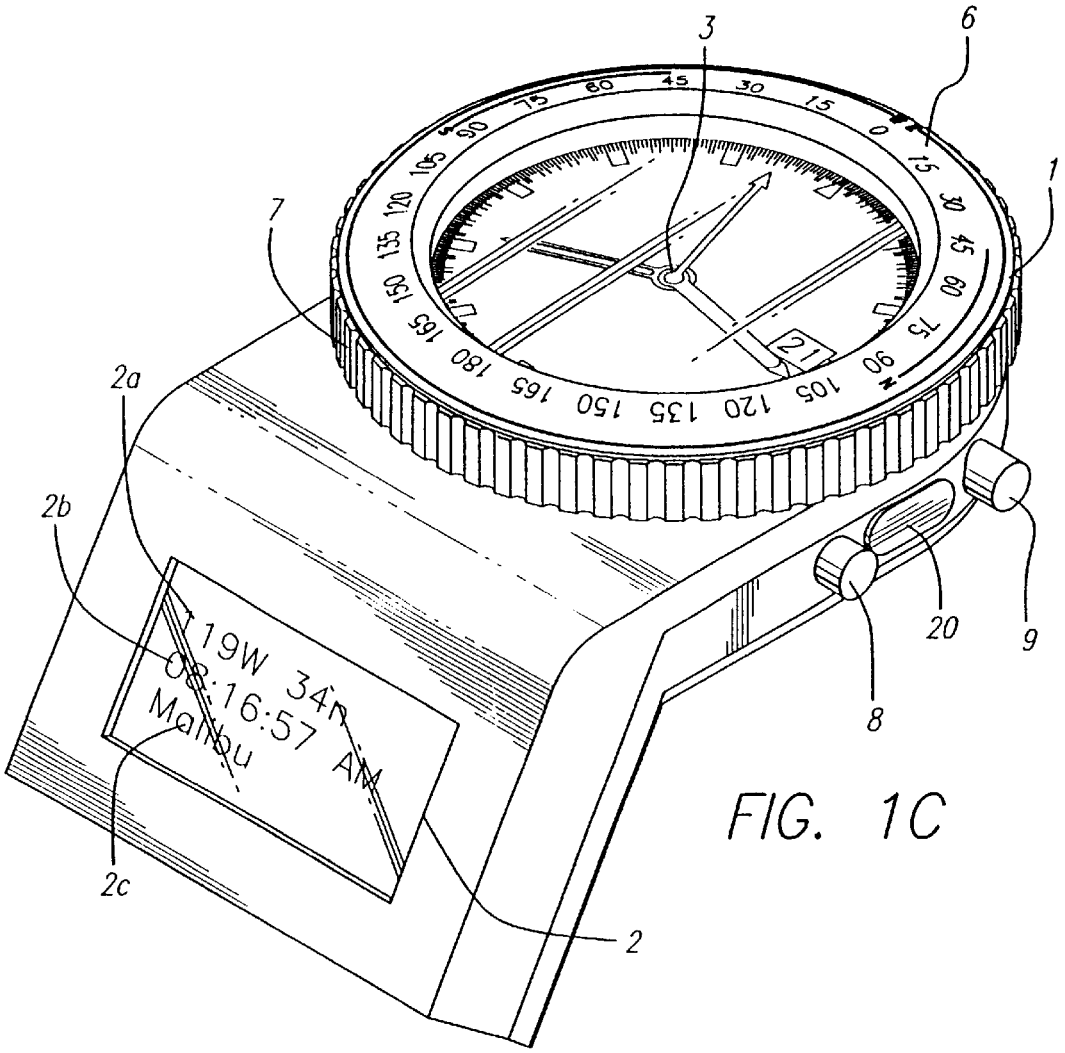
FIG. 1C

| Code | Description | |
|---|---|---|
| | | |
| N | No daylight savings used | |
| J8 | Starts April 20 at midnight, ends on October 26 at midnight | |
| M9 | First Sunday in April, 2AM to last Sunday in October, 2Am | |

METHOD AND APPARATUS FOR PROVIDING TIME USING CARTESIAN COORDINATES

BACKGROUND OF THE INVENTION

1. Field of the Invention

The present invention relates to an electronic wristwatch which has the ability to compute the local time based on cartesian coordinates which are entered through the bezel or GPS unit which acts as a high resolution data entry mechanism. This device is of particular interest to aviators and other professionals.

2. Prior Art

This invention is directed to a method for retrieving the local time adjusted for local observance of daylight savings time at any location on earth by entry of the cartesian coordinates corresponding to that location. In the preferred embodiment, this invention is described in the context of a wristwatch. In order to achieve a system which operates with an extremely high degree of resolution it is necessary to use a high resolution input device. In this respect, previous methods of inputting data into a wristwatch have fallen far short of achieving the necessary resolution to accommodate the entry of cartesian coordinates without resorting to a keyboard. In addition, there are no other known systems which provide the local time at a specified location based on cartesian coordinates.

The crown of the watch has long been used as a means of providing power to the watch through winding, setting the hands of the watch both mechanically and electronically by using small electric pulse generators, entering information into the watch, and changing the mode of operation of the watch. However, the crown is not adaptable to being a high resolution input device as it is extremely small and difficult to maneuver.

For instance, U.S. Pat. No. 5,477,508 discloses a cylinder or thumb wheel which is disposed perpendicular to the normal position of a crown. This thumb wheel is used to scroll through a variety of menus. The speed of thumb wheel rotation controls the speed of scrolling. The desired menu selection is chosen by pressing a button. This provides an inconvenient and hard to access user interface. In U.S. Pat. No. 4,726,687 an analog timepiece with data entry dials is proposed. This illustrates the primary obstacle in creating a complex watch interface which has been the need to use miniature physical controls for the great multiplicity of commands required to be input. The proposed watch overcomes some of these problems by employing a large ring control device connected to an absolute encoder thereby providing a great multiplicity of positions.

Several methods of utilizing capacitive encoding to provide absolute encoding to detect the position of a shaft are known. The primary limitation of these methods, however, is the width of the track for the capacitive pads. When applied to a watch sized encoder, none of the prior art methods use a track less than one-half inch wide. In order to be useful under the bezel of a watch, the track needs to be approximately one-eighth inch wide. The instant invention complies with the spatial requirements of a wristwatch.

Various other methods of implementing absolute encoding, using brushes with multiple tracks or multiple brushes with two tracks currently exist. But the multiple track encoders are too wide to fit under a bezel, and the multiple brush encoders suffer from a low life span. In the proposed invention, a system for absolute encoding is disclosed which uses one track, multiple brushes, and has a very long life span and complies with the spatial requirements of a wristwatch.

Many methods have been proposed to establish and display local time at multiple points on the earth with a watch. Some systems assume the 24 theoretical time zones spaced every 15 degrees around the earth is correct. These methods are inaccurate because over all of the major land masses the time zone borders do not closely trace the longitude lines.

Other watch systems can provide the local time at a number of cities around the world. For example, in U.S. Pat. No. 4,316,272 a system is disclosed whereby a marker can be manipulated to provide the time at a variety of cities displayed around the circumference of the watch face. In another method disclosed in U.S. Pat. No. 4,681,460 an indicator is displayed on the LCD next to the name of a city printed on the bezel and the watch provides the local time at the indicated city. Other list-based approaches have been proposed. However, these list-based systems are limited by the completeness of the lists which often do not accurately account for more remote cities and regions. It is clear that these list-based methods fall far short of providing the accurate local time at any point on earth.

In U.S. Pat. No. 5,408,444 a wristwatch incorporating a GPS system ascertains local time by determining whether the city located nearest the watch at its receiving point is coincident with the city located nearest the preceding receiving point. If they are coincident, the time can be displayed from memory. If not, the city nearest the present receiving point is accessed in memory, and the time of that city is displayed. The disadvantage of this method is that there are a vast number of locations on earth where the nearest major city is not in the same time zone as locations (cities) nearby. The list of known cities in the world is over 254,000 at present. Although select cities can be accounted for in the database, there will be many locations "near" a certain city which are in a different time zone than the city itself. Thus, this system will often provide an inaccurate time. The proposed invention overcomes this problem by accessing time geographically regardless of proximity to a city.

SUMMARY OF THE INVENTION

The object of this invention is to provide an improved multi-function electronic analog and digital timepiece which can provide the local time based on cartesian coordinates which are entered through a high resolution entry device. In one embodiment of the invention, the bezel is used as a high resolution entry device.

The bezel has a means of using electronic decoding to give absolute position to an extremely high degree of resolution, so that the bezel setting is not lost when the power is shut down, and the bezel can be used to enter a plurality of digitally translatable positions.

Another object of the invention is to provide a world time watch which will allow the user to set the local time of the watch to any point location on earth, regardless of the proximity of a city, by entering the cartesian coordinates of the location. In addition, the time at the location will be automatically corrected for daylight savings time in accordance with the local method of observance, if applicable.

Another object of the invention is to provide a world time watch which may display to the user the closest city in the database within the same time zone as the selected coordinates, or alternatively allow the user to choose a city from the database for which he would like to know the time.

When a city is chosen, the coordinates of the city are accessed from memory, and the time is computed using the same method used when the coordinates are entered by the bezel or GPS. Thus, this aspect of the invention allows the user to access time in a manner he may be more accustomed to.

Another object of the invention is to provide a world time watch which may be updated so that the data contained within the memory of the watch is current.

Another object of the invention is to provide a world time watch which has the capacity to receive and store customized information to enable the watch, for example, to perform astronomical calculations at point locations, access any of the present world calendar systems, and perform other calculations useful to aviators and other professionals.

Another object of the invention is to provide a world time watch which is GPS ready. The watch can be updated both for correct time and location by a separate GPS unit, either manually by the user, or through a cable, optical or spread-spectrum interface.

Another object of the invention is to provide a world time watch which can be linked to a larger database external to the watch. This can be done through radio transmissions, modem, optical, spread-spectrum or other appropriate interfaces.

The proposed invention has been designed to overcome some of the problems encountered in past designs of multi-function electronic watches. In the proposed invention, the bezel has been incorporated as a digital entry device. It is used to set the time of the analog portion of the watch, enter the longitude and latitude, and to scroll through the menus of the watch functions. The longitude and latitude are engraved on the surface of the bezel to aid the user in entering this information. The position of the bezel and the selected mode of the watch are displayed by the LCD.

The bezel encoder can be implemented using an absolute contacting encoder to give a high degree of absolute resolution. The bezel can also be used to scroll through databases stored in memory. These databases include cities along with their corresponding cartesian coordinates, information about airports and cities, and other data which the user might want to access while travelling.

If the user owns a GPS, he may enter the cartesian coordinates from the GPS, or if the GPS has a compatible output, it may be directly coupled by an appropriate interface to the watch to correct the time as well as transferring the location information to the watch. GPS satellites use extremely accurate time-keeping clocks, and after computations are made to correct for the propagation delay from the satellite to the location of the GPS, a very accurate time is available to the user. The use of the GPS allows accurate time to be calculated and corrected for propagation delay, which is not possible using signals received by radio set watches currently. In addition, the GPS gives worldwide coverage unlike radio signals which are limited to certain countries or continents.

BRIEF DESCRIPTION OF THE DRAWINGS

FIG. 1B is a view of a second embodiment of a wristwatch having the same functionality as the wristwatch described in FIG. 1A.

FIG. 1C is a view of the wristwatch after selected cartesian coordinates have been entered.

DESCRIPTION OF THE PREFERRED EMBODIMENT

The present invention is directed to a multi-functional world time watch for providing the local time and other data at any location in the world through entry of the cartesian coordinates associated with that location. This invention also provides a high resolution data entry mechanism integral to the world time watch for entering precise cartesian coordinates and for other forms of data entry.

Figure 1A:
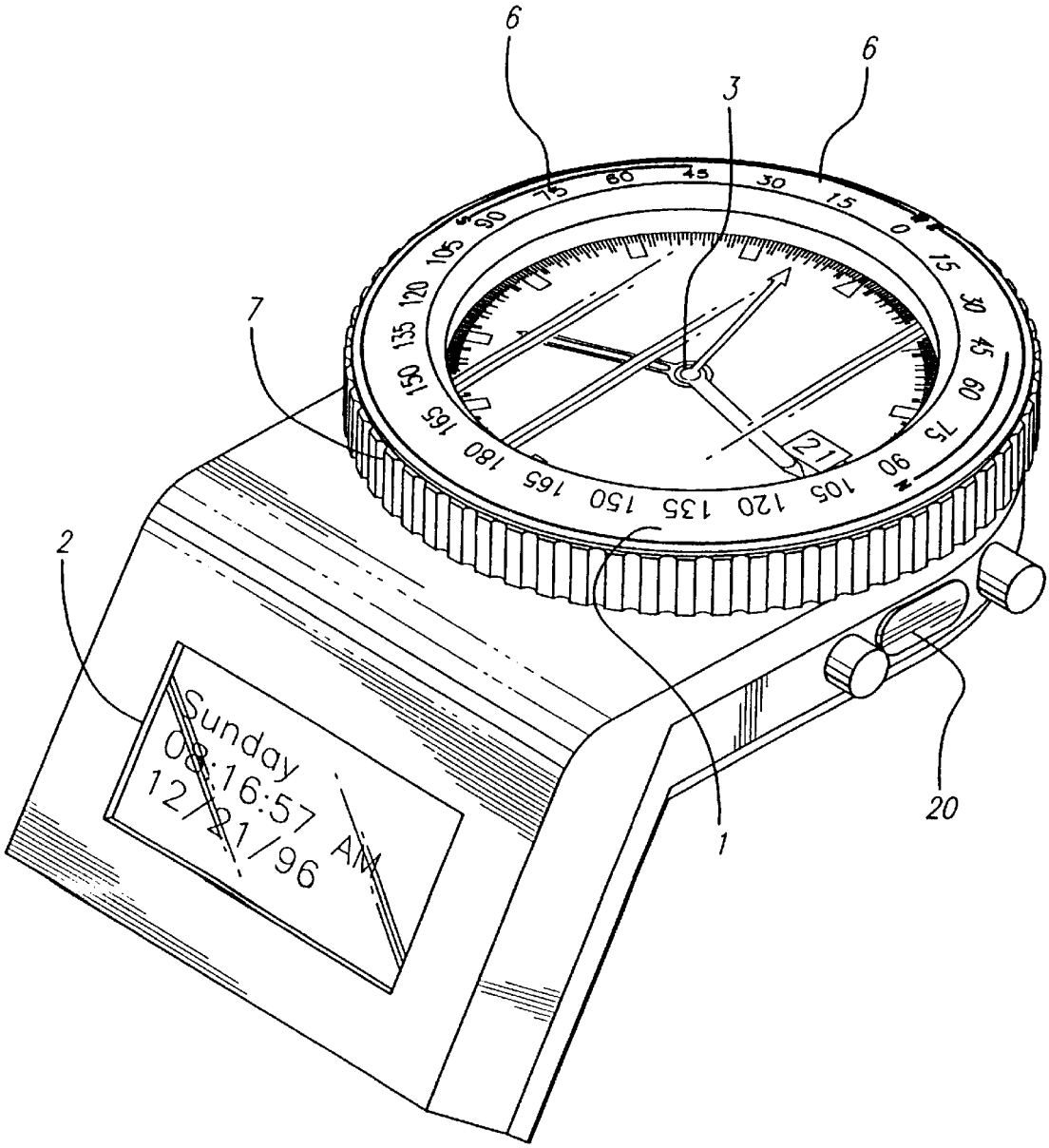
FIG. 1A is a view of the preferred embodiment of a wristwatch which has the capacity to locate the time at any point location on earth by entering the cartesian coordinates through its bezel.

Referring to FIG. 1A, the watch incorporates a bi-directional rotating bezel 1 as a high resolution input device. The watch contains an LCD 2 which is disposed below the rotating bezel 1. In FIG. 1A the LCD is disposed on an extension of the watch which is contoured to conform with the user's wrist. Obviously, the shape of the watch can readily be varied to suit any particular needs without departing from the scope of the invention. Analog display 3 is disposed within rotating bezel 1. The longitude 6 and latitude 7 indices are marked on the rotating bezel 3. The database can be updated through an external port 20 which may, for illustrative purposes, be an optical, spread-spectrum or other suitable interface. This port 20 enables interaction between the watch and an external source. It is contemplated that this apparatus could incorporate a built-in GPS which would enter certain cartesian coordinates automatically.

According to one embodiment of the invention, the interface of the watch is compliant with the Infrared Device Association's specification for hardware communications. This will allow the watch to communicate or exchange data with compliant devices such as televisions, VCR's, PDAs, desktop computers, and portable computers. Applications can be developed to execute in the watch's microprocessor which will allow it to function in other ways than a timepiece.

In addition to or instead of an infrared interface, spread spectrum radio communication may be used when applicable to allow the watch to communicate with devices close to the watch but shielded by clothing or walls. This is useful in cases where extended remote control is desired, telephony functions are desired to be implemented, or the watch is used as a display terminal for a more powerful microprocessor not physically connected to the watch.

Referring to FIG. 1B, an alternative physical embodiment of the present invention is disclosed. In this embodiment, a subsidiary analog display 4 is illustrated. This subsidiary analog display 4 can be used to show the local time at one location, while the main analog display 3 indicates the time at a different location.

Figure 2A:
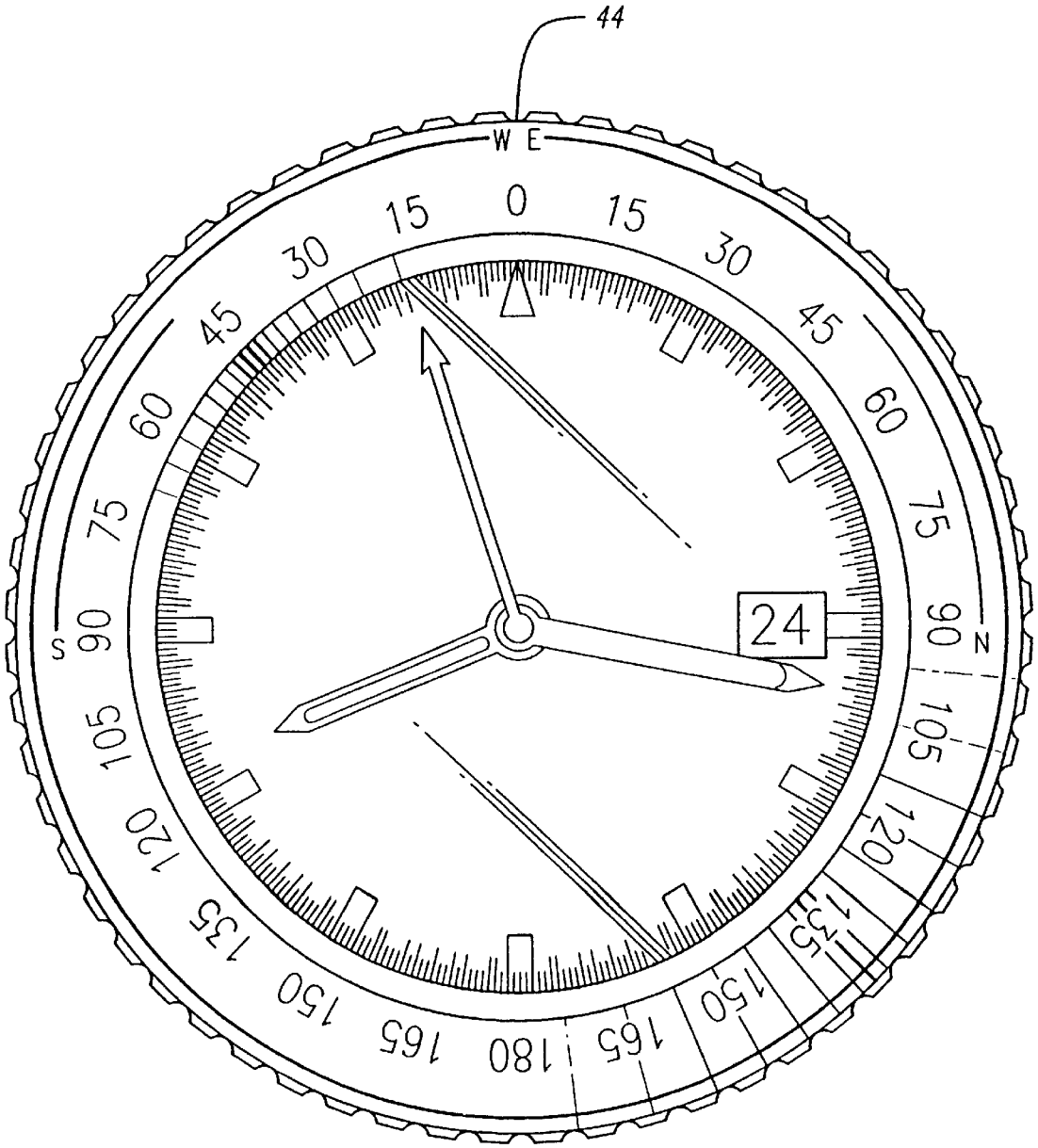
FIG. 2A is a view of the indices inscribed on the bezel.
Figure 2B:
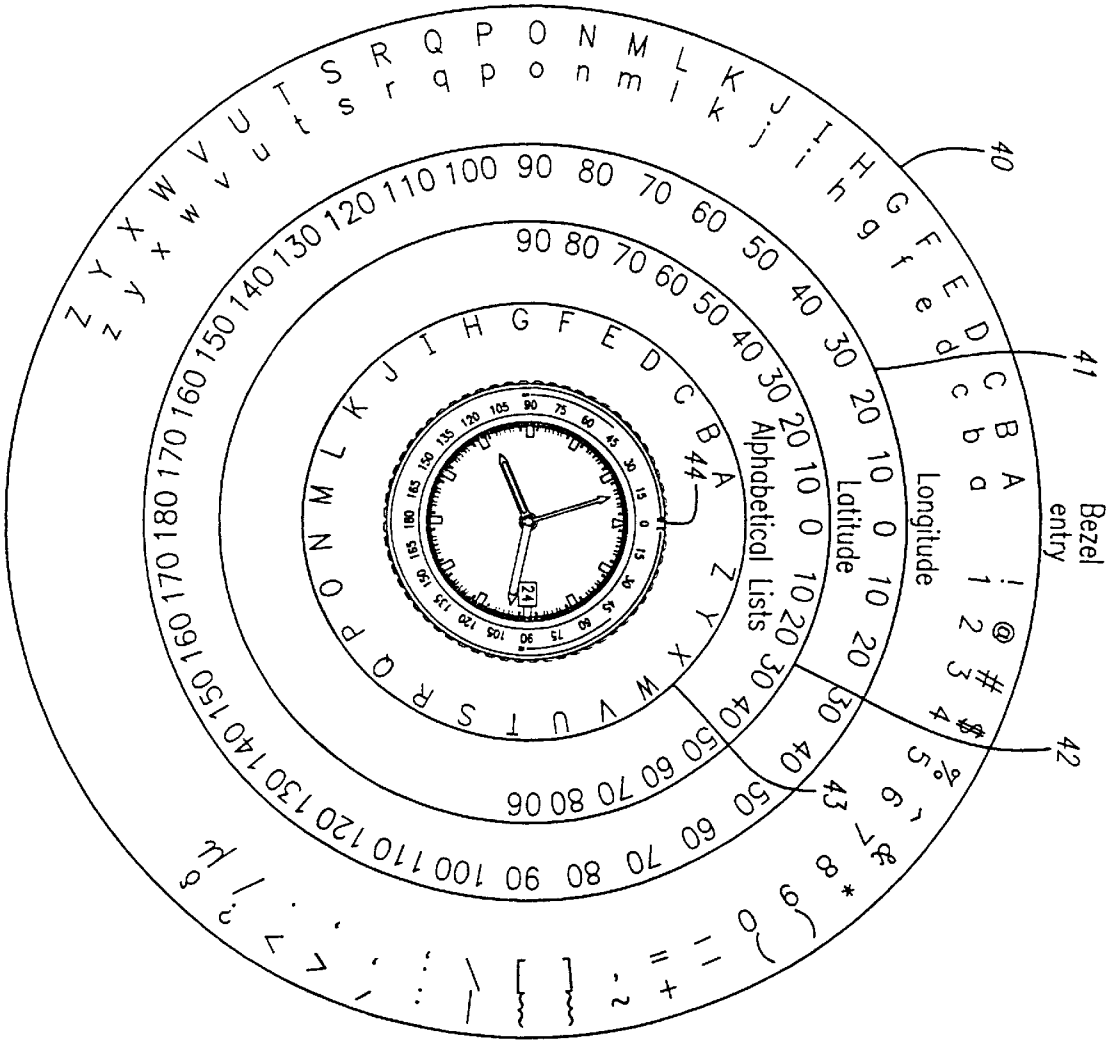
FIG. 2B is a view of the various categories of data which may be entered through the bezel.

Referring to FIG. 2A, the indicia inscribed on the rotating bezel 1 is illustrated. The various categories of data input which may be entered through rotating bezel 1 are illustrated circumferentially around the rotating bezel 1 in FIG. 2B. On the outermost circumference in FIG. 2B the category of input corresponds to the letters, numbers, and other typical keyboard entries 40. The range of longitude entries 41 are illustrated in the circle immediately adjacent to the keyboard entries. Next, the latitude entries 42 are illustrated. And finally, in the innermost ring, an alphabetical list 43 surrounds the face of the watch. In operation, a user selects a category from which he wishes to input data by pressing upper select button 9. The user then rotates bezel 1 until the desired data entry is positioned at a predetermined reference point 44. The character to be entered will be displayed on the LCD 2 in FIG. 1. At this time, referring to FIG. 1C, the user enters the particular data by pressing lower select button 8.

Referring to FIG. 1A, the LCD, in its default state, displays the date and local time at a particular location. Referring to FIG. 1C, after a particular longitude and latitude 2A have been entered, the LCD 2 displays the input longitude and latitude 2A and the time at those coordinates 2B. According to one embodiment of the invention, the closest city 2C in the same time zone to the selected coordinates may also be displayed. As explained in more detail below, scrolling to the "City Information" menu selection causes information about that city to be displayed.

Figure 3:
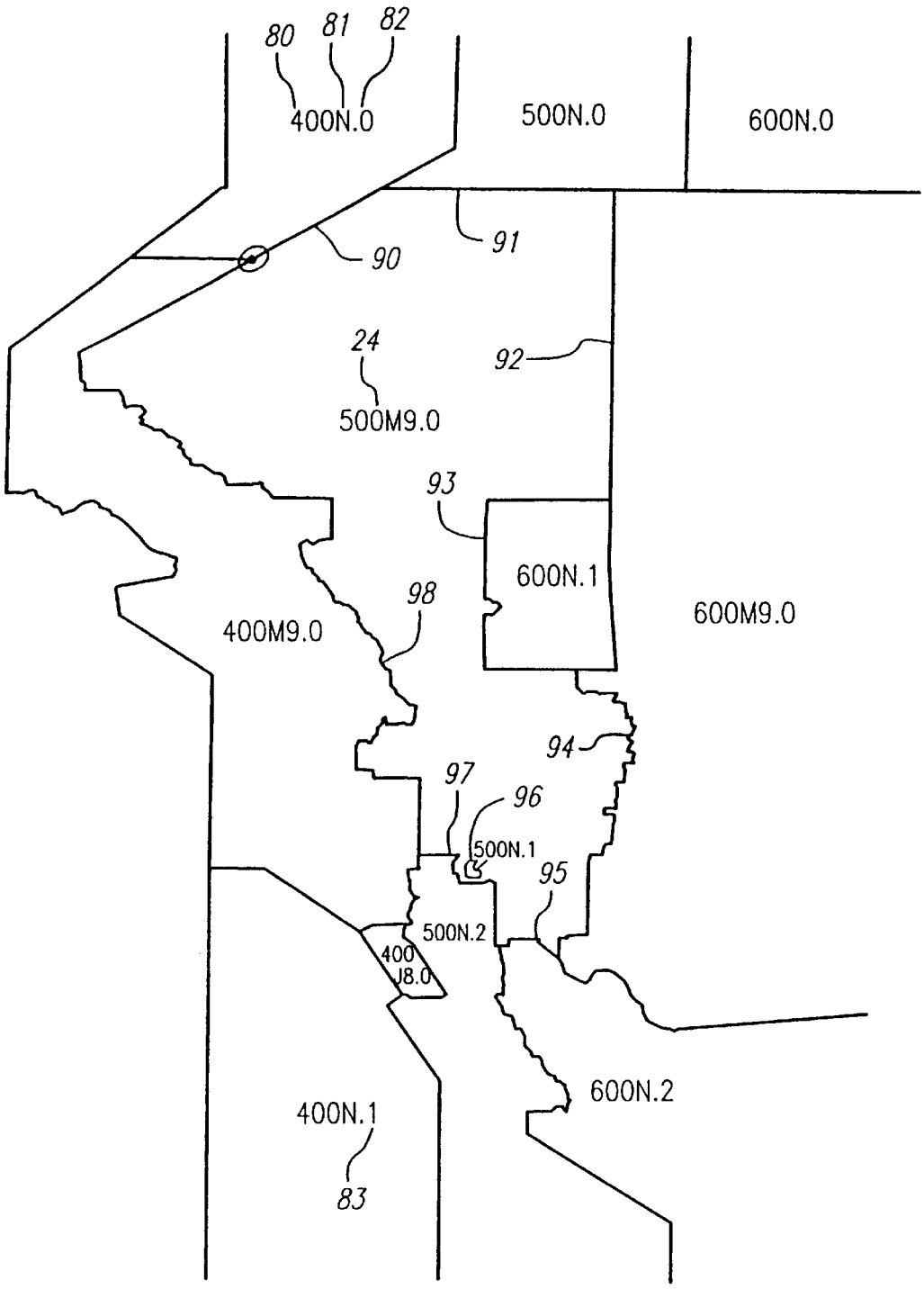
FIG. 3 is an illustration of various time zones in the central parts of Canada, the United States and Mexico drawn to an accuracy of approximately 1/180th of a degree.

A database of world time zones is arranged and stored within the memory accessed by a microprocessor disposed within the watch. Relevant information from each country is gathered concerning the delineation of time zones and the observance of daylight savings time within different regions of each country. Referring to FIG. 3 which includes the State of Arizona, and portions of central Canada, the United States, and Mexico, the information compiled is very precise. The borders 90–98 of internal time zones 24 are traced to approximately 1/180th of a degree accuracy, which equates at a maximum to approximately 0.4 miles at the equator. In some cases, daylight savings time is observed in some regions and not in other regions within a single country or state. These regions are also defined very precisely to 1/180th of a degree as a separate time zone.

The database is stored as points in vector file format. A vector map of the world is compiled based on vectors from the many available sources including the Digital Chart of the World, the World Data bank II, and/or the World Vector Shoreline. Information relating to time zone borders and regions where daylight savings time is observed (along with corresponding start and stop dates) are added to the vector database by adding the appropriate boundaries. A distance off the shoreline, such as the twelve-mile limit or another acceptable distance is established for the time zone change at shorelines when necessary.

Figure 5A:
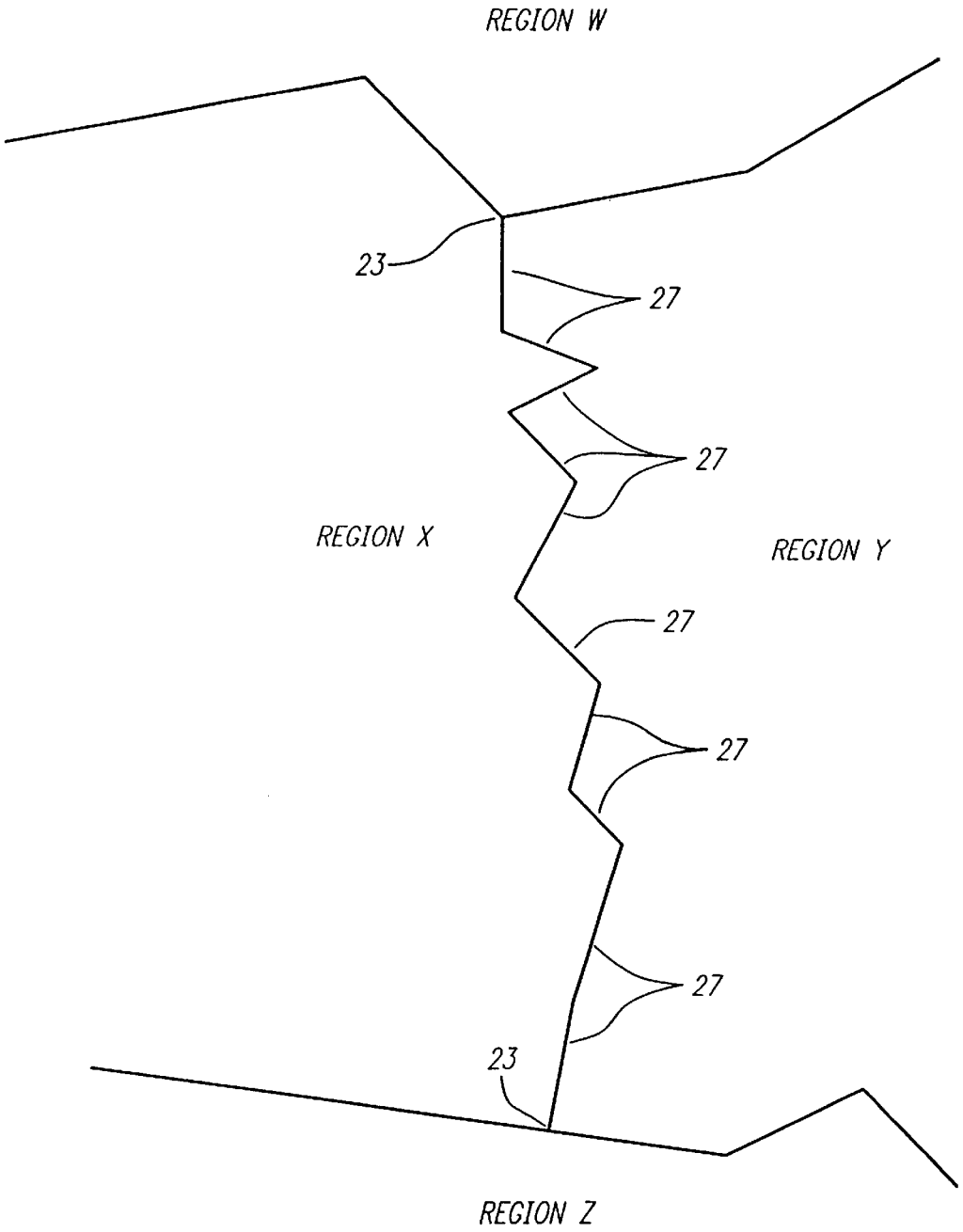
FIG. 5A is an illustration of a boundary line including its constituent vector lines.

Referring to FIG. 5A, boundary line 23 is comprised of many individual vector points which can be conceptualized as forming vector lines 27 by connecting the vector points from north to south. All of these individual vector points comprising a boundary line have the same name as their associated boundary line. Thus, the vector lines 27 comprising boundary line 23 have the same name as the associated boundary line 23. The first portion of the name of each boundary line (and its associated vector points and lines) corresponds to the polygon to the west of the boundary line ("x"), and the second portion of the name of each boundary line (and its associated vector points and lines) corresponds to the polygon to the east ("y").

A naming convention has been developed to use with the time zone database. It allows the software to have immediate access to the information needed to give the local time at any coordinate point. The time zone name is made up of three parts. The first is the offset from the international date line, indicated as 80 in FIG. 3, represented in numerals starting at 000 and running through 2500. The first and second (leading "0's"are not printed) numerals indicate the number of hours offset from the international date line, and the last two numerals provide the number of minutes offset from the international dateline within each region.

Figures 4, 8:
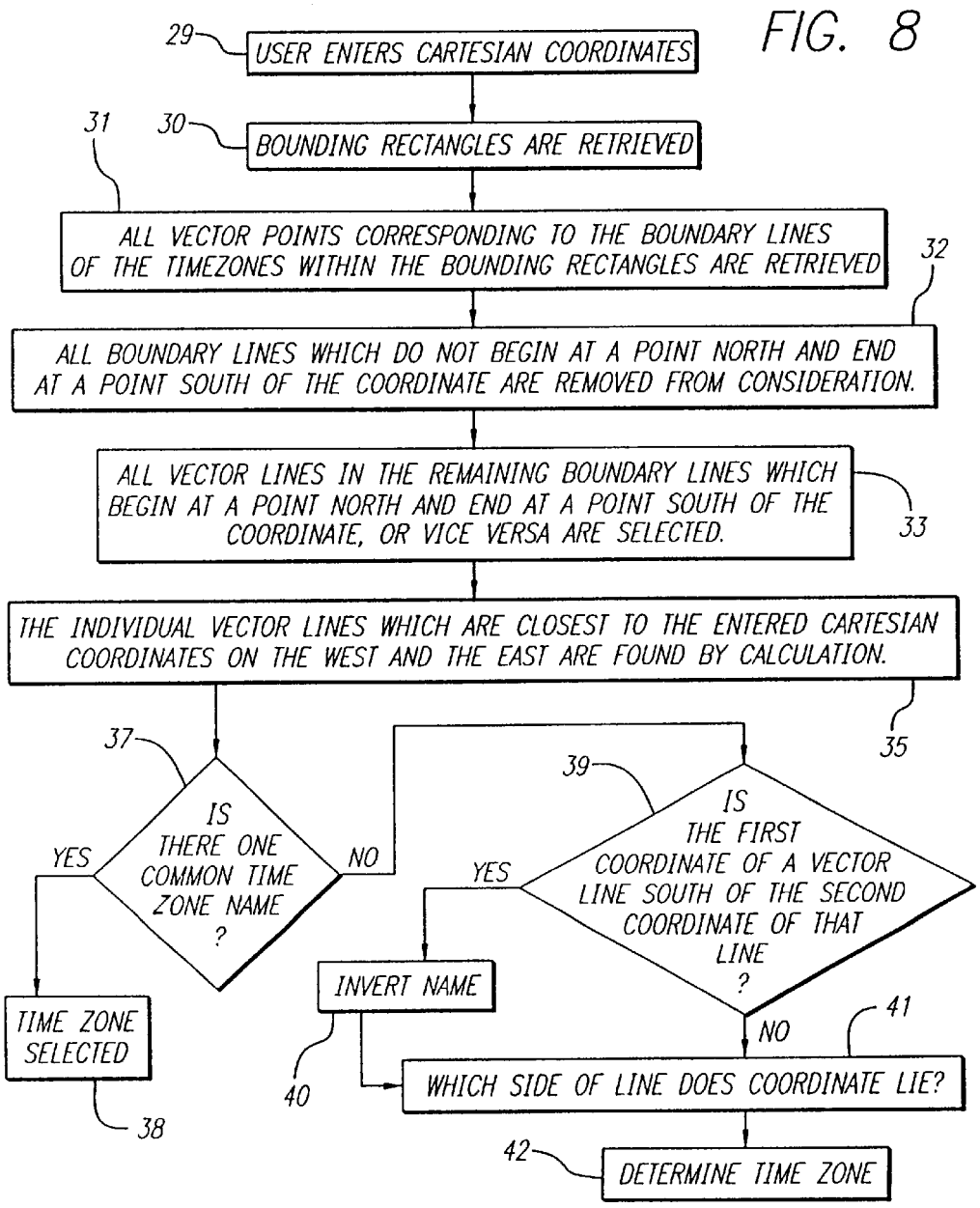
FIG. 4 is a table matching the daylight savings observance codes used in FIG. 3 with start and stop dates.
FIG. 8 is a flowchart illustrating the steps taken to access the database to determine the local time corresponding to selected cartesian coordinates.

The second part of the time zone name provides the daylight savings code, indicated as 81 in FIG. 3. This code is in the form of a letter and a number, or in the case of the letter N, there is no associated number. This code references a table of start and stop dates of the corresponding time zone. Referring to FIG. 4, examples of the code and the corresponding use of daylight savings time are provided for the codes illustrated in FIG. 3. The current date is compared to the start and stop dates to determine if a daylight savings adjustment needs to be made.

There can be multiple polygons (corresponding to multiple time zones) using the same time method. The third part of the time zone name 82 in FIG. 3 is the series number which indicates which of the multiple polygons using the same time methodology is contained therein. This is illustrated in FIG. 3 by the time zone components 82 and 83.

The boundary lines divide two adjacent time zones from each other, and are each given a composite name of the two time zones it separates (including the daylight savings code and series number). Referring to FIG. 3, using the time zone 500M9.0 as an example, each time zone region 24 is a polygon. This time zone polygon 24 is bordered by multiple boundary lines 90–98 which separate adjacent time zone regions. Each boundary line 90–98 in the database is named by combining the names of the two regions it separates. The convention of naming used is such that the time zone to the west is used first in the composite name. In the case of a border being discontiguous between two time zones, as in borders 92 and 94, an iteration, beginning at ".0", is used. The name of the border indicated by 92 would thus be 500M9.0/600M9.0*0. The name of the border indicated by 94 in would be 500M9.0/600M9.0*1. The name of the border indicated by 98 in Would be 400M9.0/500M9.0. The special characters ".", "/", and "*" are used as separators to assist the software in the decoding of the data. Thus, the world is divided into polygons, each of which contains a discrete region using time in the same manner year round, including providing for daylight savings adjustments wherever applicable.

In 1996, there were 88 unique major time zones including 22 different methods of utilizing daylight savings time. In addition, there were small geographical pockets that used time in a different manner than its surrounding region. There are also discontiguous areas which use same time methodology which are considered as separate time zones. The time zone database may be updated continuously by contact with each local or national governmental agency for every country.

Figure 7:
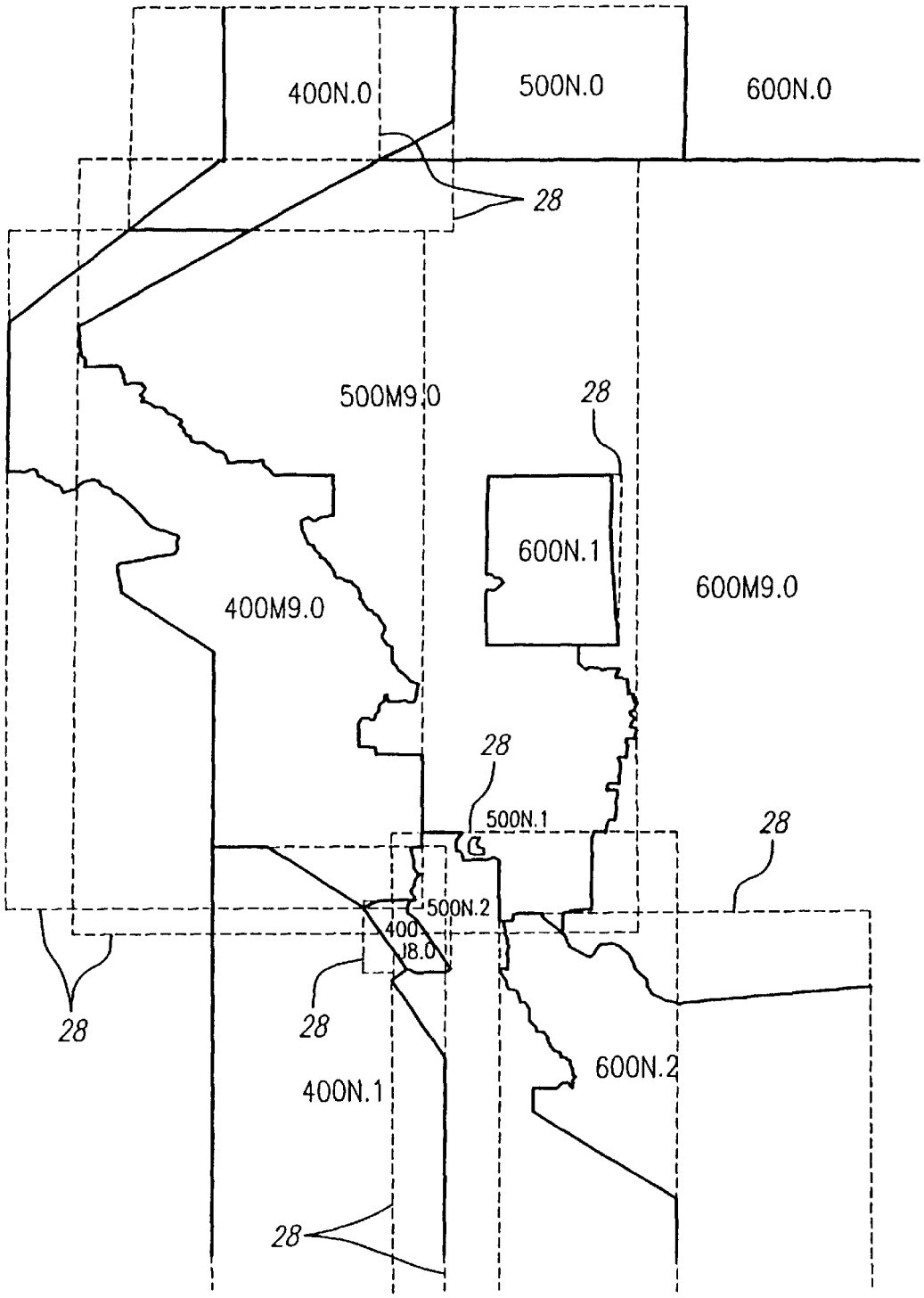
FIG. 7 is an illustration of bounding rectangles encompassing the various time zone polygons and daylight savings polygons in central parts of Canada, the United States and Mexico.

Referring to FIG. 7, in order to expedite database searches, each time zone polygon is also represented in the database by the smallest possible rectangle 28 (dotted line) which bounds the entire polygon. The purpose of the bounding rectangles is to enable the microprocessor to quickly determine which boundary lines are in the proximity of the entered cartesian coordinates. The effect is to severely restrict the number of boundary lines which need to be considered in determining which time zone polygon the selected cartesian coordinates are situated within.

Referring to FIG. 8, once cartesian coordinates are entered 29, all of the bounding rectangles of polygons representing time zones which enclose the coordinate are retrieved from the database 30. All vector points which comprise the boundary lines of polygons corresponding to the retrieved bounding rectangles are retrieved 31. All retrieved boundary lines, as defined by its constituent vector points, which do not originate north of the selected coordinate and terminate south of the selected coordinate (or vice versa) are eliminated from consideration 32. All vector lines (formed conceptually by connecting adjacent vector points) which do not begin north of the selected coordinates and end south of the selected coordinates (or vice versa) are eliminated 33. Thus, the two pairs of vector points in the remaining boundary lines which are closest on either side of the entered coordinate in the north/south axis are selected 33. These two pairs of vector points can be conceptualized as forming two vector lines which connect the pairs of vector points. The vector lines which bound the selected coordinate closest on the east and west can be calculated mathematically 35. In this way, the two sets of vector points which border the selected coordinate on the east and the west are selected. In this embodiment of the invention, horizontal lines are insignificant.

It should be understood by one skilled in the art that this invention contemplates calculating the pairs of vector points which border the selected coordinates on the north and the south. This north/south technique can be used instead of the east/west technique, or in combination to enable even greater resolution and accuracy of the system.

The polygon in which the selected coordinates fall can be derived by looking at the names of the vector points (lines) which have been calculated to be the closest to the selected coordinates and by determining common time zone names amongst the various vector points (lines) 37.

If there is only one polygon name which is common to the two vector line names, then the selected coordinate is located within that common polygon 38. If there are two polygon names which are common to the vector lines, then the order in which the polygon names appear in the vector lines must be considered 39. For instance, since the western polygon is always represented in the first portion of the name and the eastern bordering polygon is always represented in the second portion of the name, one can calculate which polygon the selected coordinates are enclosed within by referencing the closest vector lines.

Figure 5B:
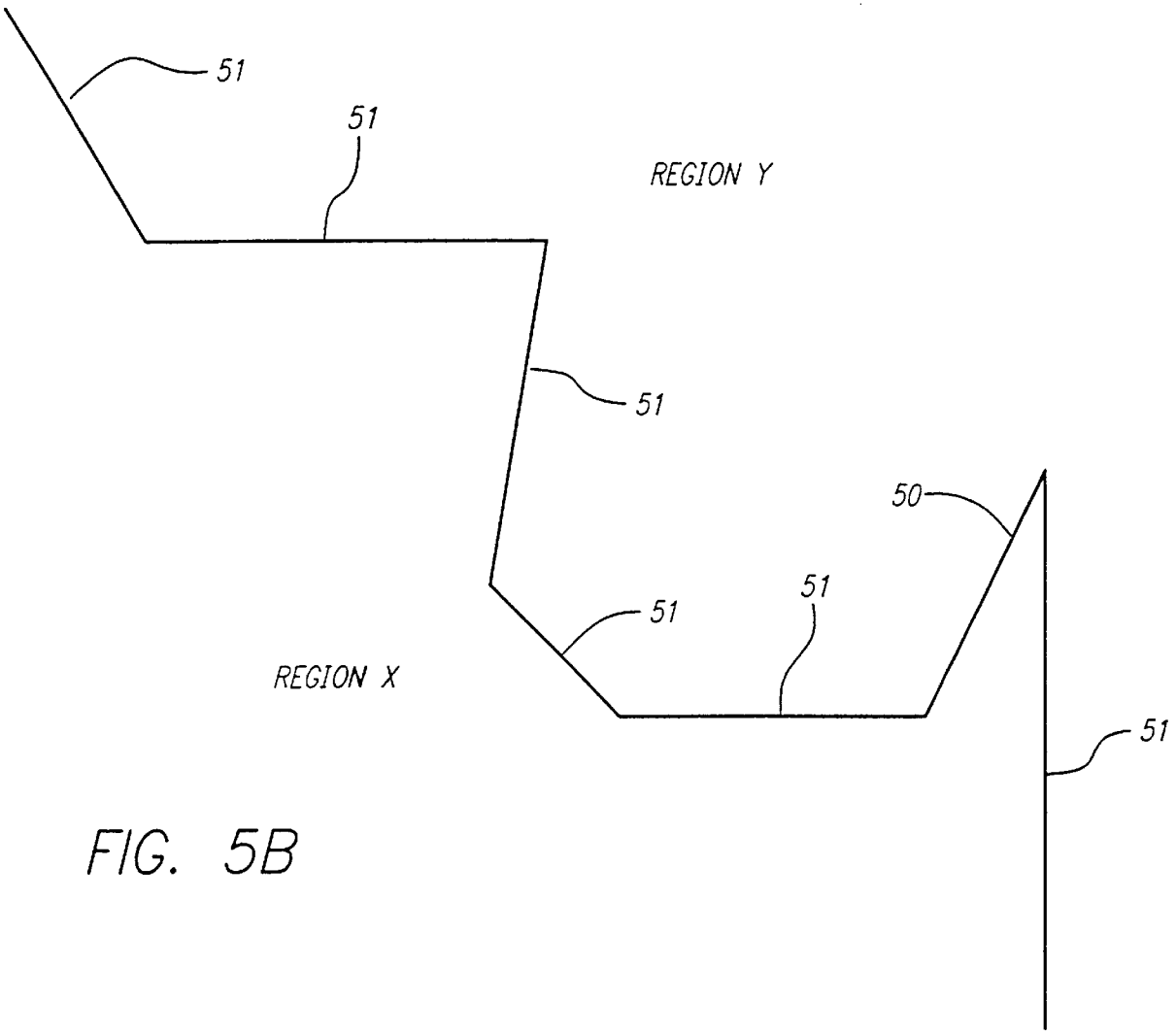
FIG. 5B illustrates a scenario where the sequence in which a vector line is named needs to be reversed.

However, if as one progresses down a boundary line from north to south, one or more vector lines advance north (i.e., the first vector point reached is south of the second vector point reached), then the names of those one or more vector lines should be inverted. Thus, as shown in FIG. 5B, if a vector line 50 advances north as one descends down a boundary line, then the order of the names associated with that vector line should be reversed so that the polygon to the west of that particular segment line 50 comprises the first component of the name of the vector line. In any vector line 51, the polygon to the west is region X (horizontal lines do not matter). When the line turns to the north, however, the polygon to the west becomes the opposite polygon, as occurs in vector line 50. Thus the naming convention can be adjusted so that the location of the polygon in which the entered coordinate lies can be calculated. After the names are inverted if necessary 40, the time zone is determined by calculating which side of the selected vector lines the point lies 41 and determining the time zone by referencing the appropriate element of the name of that line 42.

Figure 6A:
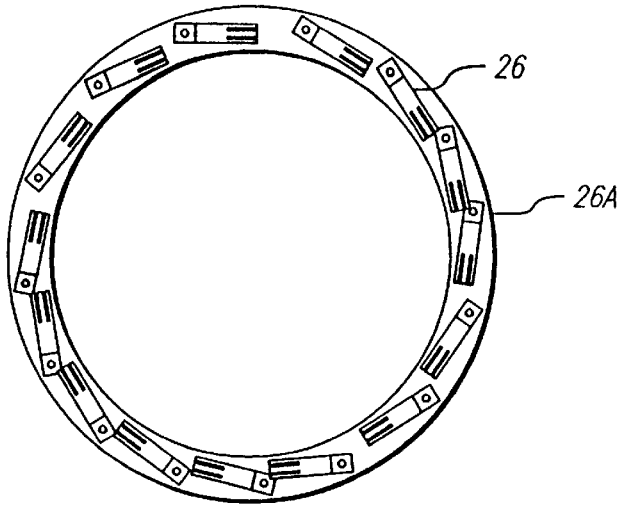
FIG. 6A is the layout of the fifteen brushes on the underside of the bezel.

Referring to FIG. 6A, the underside of the bezel has an array of fifteen brushes 26 attached to it. These brushes are grounded to the case of the watch (not shown). According to the preferred embodiment, the brushes are mounted on a brass ring 26*a* which is pressed into the underside of the bezel.

Figure 6B:
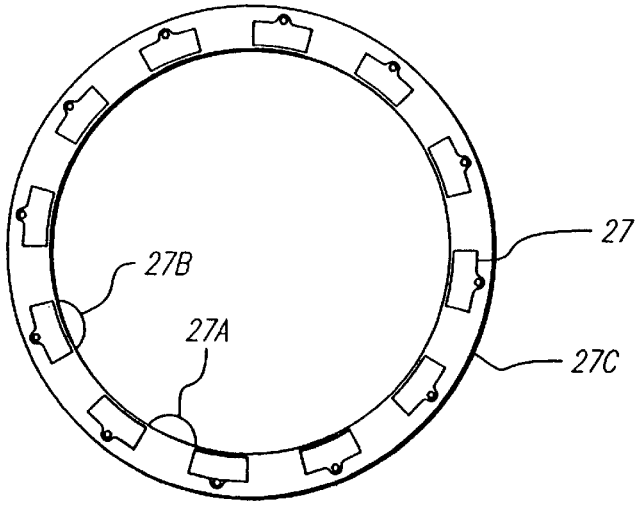
FIG. 6B is the layout of the twelve pads which contact the brushes.

Referring to FIG. 6B, a circular ring 27*c* disposed below the rotating bezel 1 has twelve contacting pads 27 disposed thereon at equally spaced fifteen degree intervals 27A. Each contacting pad 27 is fifteen degrees in length 27B. Each of these pads 27 is coupled to a port pin of the microprocessor (not shown). Each port pin is pulled up through a resistor to a predetermined Vcc level. According to the preferred embodiment of the invention, the circular ring 27*c* is made of ceramic, and the contacting pads 27 are made of palladium silver, and the ceramic outside the pads is fired with glass.

Figure 6C:
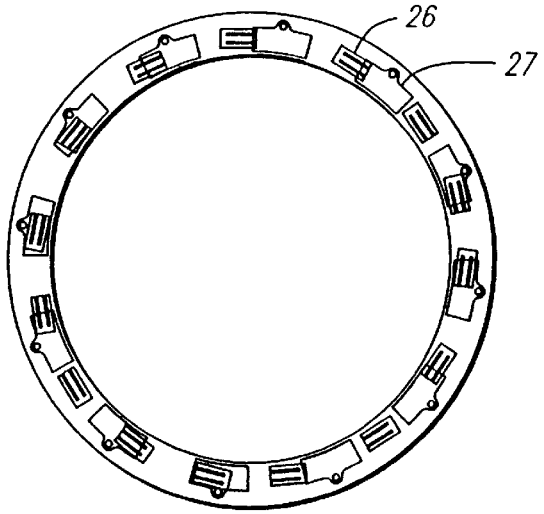
FIG. 6C is a top view of the electrical brushes superimposed on to the contact pads.

Referring to FIG. 6C, when a brush 26 contacts a pad 27 the voltage level at the pad 27 goes to zero because the brush is grounded. Thus, at the pads 27 which are in contact with one of brushes 26 the voltage level is low (indicated as binary "0"). At pads 27 which are not in contact with any of the grounding brushes 26, the voltage level is high (indicated as a binary "1"). The arrangement of the brushes 26 and pads 27 is such that the binary code provided by the twelve contact pads 27 is unique for each one degree of rotation of the bezel 1. Thus, every one degree of rotation of bezel 1 the pattern of brushes 26 touching contact pads 27 changes. The resulting binary code is decoded by the microprocessor to give the absolute position of the bezel 1 from a cold start-up. The use of grounding brushes 26 eliminates the need for additional brushes and a grounding strip on the circuit board.

In an alternative embodiment of the invention, two concentric bezels can be utilized. If two bezels are used, each bezel will couple its own set of pads to its own set of electrically conducting brushes to give independent settings for the longitude and latitude.

The preferred embodiment includes a method and means for performing astronomical calculations. The sunrise, sunset, moon phase, moon rise, and moon set can be calculated at any time and location corresponding to selected coordinates.

The preferred embodiment includes an application for a universal perpetual calendar. "Universal" refers to the capacity to implement any of the world calendar systems and to display the appropriate date information in that calendar system. "Perpetual" refers to the capacity of the algorithms used to accurately calculate all calendar dates back to the beginning of the calendar, and project all dates of the calendar in perpetuity. As calendar systems change, or new systems evolve, the algorithms can be updated.

Each of the world calendar systems uses prescribed algorithms to arrive at the present date in that calendar system. Each system has a date which, if the calendar system is traced back, would be the 0 date of the system. The algorithms used in each calendar system have been encoded, along with the particular names of months, days, and other pertinent information for each system so that it can be available to the user. In some cases, there have been corrections within particular calendar systems in the past. These corrections are implemented in the systems where known, so that the calendars are backward compatible. An example of this exists in the Gregorian calendar. When the Gregorian calendar was instituted by Pope Gregory in 1582, Oct. 4, 1582 was followed by Oct. 15, 1582 in order to bring the occurrence of the vernal equinox to approximately March 21. This was done to keep the celebration of Easter in the season it was originally celebrated. For those interested in using the watch to convert historical dates, the calendar corrections built in will allow the user to convert historical dates with accuracy. Any future corrections in the calendar system made by those using it can be downloaded into the watch through the external port 20.

In the preferred embodiment of the invention, the database is contained within EPROM and EEPROM. The memory can be updated by downloading data through external port 20. For a smaller embodiment of the invention, the database can be contained within EPROM. In this version, the database is updated by erasing the EPROM and reprogramming it with the updated database.

According to the preferred embodiment, a SMC88316 microprocessor is used. The EPROM used in the preferred embodiment is a newer product by WSI, which combines EPROM, RAM, extra ports, and some logic in one chip. The EEPROM used in the preferred embodiment is made by Atmel. The use of these chips brings the component count, board complexity, and consequently the cost to a lower level than possible with either discrete components or custom ASICs.

The multi-function world time watch disclosed herein utilizes a configuration of hardware and software which can be applied to a wide range of watch, timepiece, and world time GPS applications. The technology disclosed can perform within a wide range of microprocessors. Thus, it should be realized that this description of the invention merely illustrates the principals of the invention in one specific embodiment, and in no way limits the breadth and scope of this patent which is defined by the claims that follow.

What is claimed is:

1. A method for obtaining the local time at a location by providing the cartesian coordinates of said location, said method comprising the steps of:

organizing a database of world time zones using cartesian coordinates to define geographic boundaries of world time zones, said step of organizing a database further including the steps of indicating a boundary portion for each portion of a geographic boundary separating two different time zones, and providing relative orientation information for each boundary portion entry, said relative orientation information indicating a relative orientation between said two different time zones;

specifying the cartesian coordinates of said location;

searching said database, responsive to said relative orientation information, to determine the world time zone which encloses said cartesian coordinates of said location; and providing the local time at said location.

2. The method of claim 1 further including the step of reading from said database the difference in time between said time zone which encloses said cartesian coordinates of said location and a single predetermined reference point and calculating the time at said location by using said difference in time and the current time at said single predetermined reference point.

3. The method of claim 2 further including the step of displaying the local time at said location.

4. The method of claim 1 wherein said step of organizing a database uses vector file format.

5. The method of claim 2 wherein said single predetermined reference point is the international date line time.

6. The method of claim 4 wherein said step of organizing said database of world time zones is accomplished by storing vector points which trace the borders of each time zone.

7. The method of claim 1 wherein said step of arranging said database of world time zones includes accounting for local observance of daylight savings time.

8. The method of claim 1 wherein said data is entered automatically by a GPS unit.

9. The invention of claim 1, wherein said step of searching said database further comprises the step of:

locating a closest segment of a geographic boundary portion closest to the Cartesian coordinates of said location; and responsively providing the relative orientation information associated with said located geographic boundary portion to determine the world time zone which encloses said location.

10. The invention of claim 9, wherein said step of locating said a geographic boundary portion further comprises the steps of:

searching a plurality of rectangular geographic areas, each such rectangular area enclosing a closed portion of one of said world time zones, to determine which rectangular geographic areas enclose said Cartesian coordinates of said location; and searching all world time zone boundary portions enclosed by said rectangular geographic areas, determined to enclose said Cartesian coordinates, to locate a geographic boundary portion closest to said Cartesian coordinates of said location.

11. An apparatus for providing the local time at a location by processing the Cartesian coordinates of said location; comprising:

a database of world time zones arranged by Cartesian coordinates to define geographic boundaries of world time zones, said database including boundary portion entries for each portion of a geographic boundary separating two different time zones, said boundary portion including relative orientation information indicating a relative orientation between said two different time zones;

means for entering the Cartesian coordinates of said location;

means responsive to said relative orientation information for searching said database to determine the world time zone which encloses said location; and means for providing the local time at said location.

12. The apparatus of claim 11 further including means for reading from said database the difference in time between said time zone which encloses said location and a single predetermined reference point, and means for calculating the current time at said location by using said difference in time and the current time at said single predetermined reference point.

13. The apparatus of claim 11 further including means for displaying the local time at said location.

14. The apparatus of claim 11 wherein said database is arranged in vector file format.

15. The apparatus of claim 12 wherein said single predetermined reference point is the international date line time.

16. The apparatus of claim 14 wherein said database of world time zones contains vector points which trace the borders of each time zone.

17. The apparatus of claim 11 wherein said database of world time zones is arranged to account for local observance of daylight savings time.

18. The apparatus of claim 11 wherein said apparatus is a wristwatch.

19. The apparatus of claim 12 wherein said apparatus includes a built-in GPS unit which provides the coordinates of said location.

20. The apparatus of claim 19 wherein the time at said predetermined reference point can be corrected based on signals received through said GPS unit.

21. The apparatus of claim 18 wherein said wristwatch is linked to an external device for enabling two-way communication between said wristwatch and said external device.

22. The invention of claim 11, wherein said relative orientation information is stored in said database by the order in which an identification of said two time zones separated by said portion of a georgraphic boundary separating two different time zones is stored.

23. The invention of claim 11, wherein said relative orientation information is stored in said database in the form of a naming convention associating name data with the information stored for each said geographic boundary portion.

24. The invention of claim 11, wherein said database further comprises:

name data, associated with each portion of each such geographic boundary, specifying an identification of said two time zones separated by said portion.

25. The invention of claim 24, wherein each of said name data comprises:

data specifying an identification of said two time zones separated by said portion in an order specifying said relative orientation.

26. The invention of claim 25, wherein each of said names further comprises:

data specifying further information useful for determining the local time such as an accounting for observance of daylight savings time responsively providing the relative orientation information associated with said one or two located geographic boundary portions to determine the world time zone which encloses said location.

27. The invention of claim 1, wherein said step of searching said database further comprises the step of:

locating two segments of one or two geographic boundary portions closest to the Cartesian coordinates of said location; and responsively providing the relative orientation information associated with said one or two located geographic boundary portions to determine the world time zone which encloses said location.

28. The invention of claim 27, wherein said step of locating said one or two geographic boundary portions further comprises the steps of:

searching a plurality of rectangular geographic areas, each such rectangular area enclosing a closed portion of one of said world time zones, to determine which rectangular geographic areas enclose said Cartesian coordinates of said location; and searching all world time zone boundary portions enclosed by said rectangular geographic areas, determined to enclose said Cartesian coordinates, to locate the geographic boundary portions closest to said Cartesian coordinates of said location.

29. The invention of claim 28, wherein the step of searching all world time zone boundary portions enclosed by said rectangular geographic areas, further includes the steps of:

determining two closest segments of said world time zone boundaries; and determining the world time zone enclosing the Cartesian coordinates of the location to be (a) a time zone common to the name data associated with said two closest segments if said two closest segments are from different portions of the world time zone boundaries; or (b) a time zone with a proper orientation if said two closest segments are from the same portion.

30. The invention of claim 11, wherein said step of searching said data base further comprises the steps of:

locating two segments of said geographic boundary portions as the closest to the Cartesian coordinates of said location;

determining if said closest two segments are part of the same world time zone boundary portion;

determining the world time zone enclosing the Cartesian coordinates of the location to be the time zone common between the world time zones separated by said portions if said closest two segments are determined to be part of different world time zone boundary portions, and determining the world time zone enclosing the Cartesian coordinates of the location to be the time zone a proper orientation which is associated with the closest of the closest two segments if said closest two segments are determined to be part of the same world time zone boundary portion.

* * * * *

UNITED STATES PATENT AND TRADEMARK OFFICE

CERTIFICATE OF CORRECTION

PATENT NO. : 5,982,710
APPLICATION NO. : 08/818762
DATED : November 9, 1999
INVENTOR(S) : Prem P. Rawat It is certified that error appears in the above-identified patent and that said Letters Patent is hereby corrected as shown below:

On Title page item [56] add

| | | |
|---|---|---|
| 4,109,457 | 8/29/78 | Laesser et al. |

FOREIGN PATENT DOCUMENTS

| | | |
|---|---|---|
| 44 00 626 A | 7/13/95 | DE |
| 0 498 199 A2 | 8/12/92 | EP |
| 1 368 774 A | 10/29/76 | CH |
| 42 02 435 A 1 | 8/5/93 | DE |

**OTHER DOCUMENTS (*Including Author, Title, Date, Pertinent Pages, Etc.*)**
PATENT ABSTRACTS OF JAPAN vol. 010, no. 089 (p-444), 8 April 1986 & JP 60 224087 A (SEIKOUSHIY A: KK), 8 November 1985, Col. 10, Claim 9, line 1, delete “invention”, and insert -- method --.
Col. 10, Claim 10, line 1, delete “invention”, and insert -- method --.
Col. 11, Claim 25, line 1, delete “invention”, and insert -- apparatus --.
Col. 11, Claim 26, line 1, delete “invention”, and insert -- apparatus --.
Col. 11, Claim 27, line 1, delete “invention”, and insert -- apparatus --.
Col. 12, Claim 28, line 1, delete “invention”, and insert -- apparatus --.
Col. 12, Claim 28, line 1, delete “invention”, and insert -- method --.
Col. 12, Claim 29, line 1, delete “invention”, and insert -- apparatus --.
Col. 12, Claim 29, line 1, delete “invention”, and insert -- method --.
Col. 12, Claim 29, line 5, delete “time.”, and insert -- time, --.
Col. 12, Claim 30, line 1, delete “invention”, and insert -- method --.
Col. 12, Claim 30, line 1, delete “invention”, and insert -- apparatus --.

Signed and Sealed this

Twenty-second Day of August, 2006

JON W. DUDAS
*Director of the United States Patent and Trademark Office*